US006626230B1

(12) United States Patent
Woodrum et al.

(10) Patent No.: US 6,626,230 B1
(45) Date of Patent: Sep. 30, 2003

(54) MULTI-WALL CORE AND PROCESS

(75) Inventors: Harry A. Woodrum, Muskegon, MI (US); William E. Sikkenga, Twin Lake, MI (US)

(73) Assignee: Howmet Research Corporation, Whitehall, MI (US)

( * ) Notice: Subject to any disclaimer, the term of this patent is extended or adjusted under 35 U.S.C. 154(b) by 0 days.

(21) Appl. No.: 09/696,745

(22) Filed: Oct. 25, 2000

Related U.S. Application Data

(60) Provisional application No. 60/161,502, filed on Oct. 26, 1999.

(51) Int. Cl.[7] ..... B22C 9/00; B22C 7/00; B22D 33/04

(52) U.S. Cl. ..... 164/516; 164/34; 164/35; 164/45; 164/361; 164/369; 164/370; 164/137

(58) Field of Search ..... 164/516, 34, 35, 164/45, 361, 137, 369, 370

(56) References Cited

U.S. PATENT DOCUMENTS

| | | | | |
|---|---|---|---|---|
| 2,793,412 A | | 5/1957 | Lashnrook | 22/196 |
| 4,066,116 A | | 1/1978 | Blazek et al. | 164/17 |
| 4,213,495 A | | 7/1980 | Rose | 164/34 |
| 4,617,977 A | | 10/1986 | Mills | 164/30 |
| 5,016,702 A | | 5/1991 | Ahlers | 164/34 |
| 5,295,530 A | | 3/1994 | O'Connor et al. | 164/516 |
| 5,296,308 A | * | 3/1994 | Caccavale et al. | 164/361 |
| 5,465,780 A | | 11/1995 | Muntner et al. | 164/516 |
| 5,503,218 A | * | 4/1996 | Campion et al. | 164/516 |
| 5,507,336 A | | 4/1996 | Tobin | 164/34 |
| 5,641,014 A | | 6/1997 | O'Connor et al.. | 164/516 |
| 5,820,774 A | * | 10/1998 | Dietrich | 164/369 |
| 6,186,217 B1 | | 2/2001 | Sikkenga et al. | 164/137 |

* cited by examiner

*Primary Examiner*—Tom Dunn
*Assistant Examiner*—I.-H. Lin

(57) ABSTRACT

Method making a multi-wall ceramic core for use in casting airfoils, such as turbine blades and vanes, wherein a fugitive pattern is formed having multiple thin wall pattern elements providing internal wall-forming spaces of a final core, the pattern is placed in a core molding die cavity having a desired core configuration, a fluid ceramic material is introduced into the die cavity about the pattern and between the pattern elements to form a ceramic core, and the core is removed from the die cavity. The fugitive pattern is selectively removed from the core to provide a multi-wall green core. The green core then is fired to develop core strength for casting and used to form an investment casting mold for casting an airfoil.

19 Claims, 8 Drawing Sheets

MULTI-WALL CORE AND PROCESS

This application claims the benefits of provisional application Serial No. 60/161 502 filed Oct. 26, 1999.

FIELD OF THE INVENTION

The present invention relates to a method for making multi-wall ceramic cores for casting multi-wall metal castings.

BACKGROUND OF THE INVENTION

Most manufacturers of gas turbine engines are evaluating advanced multi-thin-walled turbine airfoils (i.e. turbine blade or vane) which include intricate air cooling channels to improve efficiency of airfoil internal cooling to permit greater engine thrust and provide satisfactory airfoil service life.

U.S. Pat. Nos. 5,295,530 and 5,545,003 describe advanced multi-walled, thin-walled turbine blade or vane designs which include intricate air cooling channels to this end.

In U.S. Pat. No. 5,295,530, a multi-wall core assembly is made by coating a first thin wall ceramic core with wax or plastic, a second similar ceramic core is positioned on the first coated ceramic core using temporary locating pins, holes are drilled through the ceramic cores, a locating rod is inserted into each drilled hole and then the second core then is coated with wax or plastic. This sequence is repeated as necessary to build up the multi-wall ceramic core assembly.

This core assembly procedure is quite complex, time consuming and costly as a result of use of use of the connecting rods, pins and the like and drilled holes in the cores to receive the rods as well as tooling requirements to assemble the core components with required dimensional accuracy.

An improved method is needed for making a multi-wall ceramic core for use in casting metals and alloys. An object of the invention is to satisfy this need.

SUMMARY OF THE INVENTION

The present invention provides, in an illustrative embodiment, a method making a multi-wall ceramic core for use in casting airfoils, such as turbine blades and vanes, wherein a fugitive pattern is formed having multiple thin pattern elements defining therebetween core wall-forming spaces, the pattern is placed in a core molding die cavity having a desired core configuration, a fluid ceramic material is introduced into the die cavity about the pattern and between the pattern elements to form a multi-wall ceramic core, and the core is removed from the die cavity. The fugitive pattern is selectively removed from the core to provide a multi-wall green core. The green core then is fired to develop core strength for casting in an investment casting shell mold. The pattern elements can be formed in three dimensional pattern configuration by injection molding, sterolithographic deposition of pattern material, and other techniques.

The multi-wall ceramic core so produced comprises a plurality of spaced apart thin core walls connected together by other integral regions of the molded core. The invention reduces core assembly costs and provides high dimensional accuracy and repeatability of core walls.

DESCRIPTION OF THE INVENTION

Figure 1:
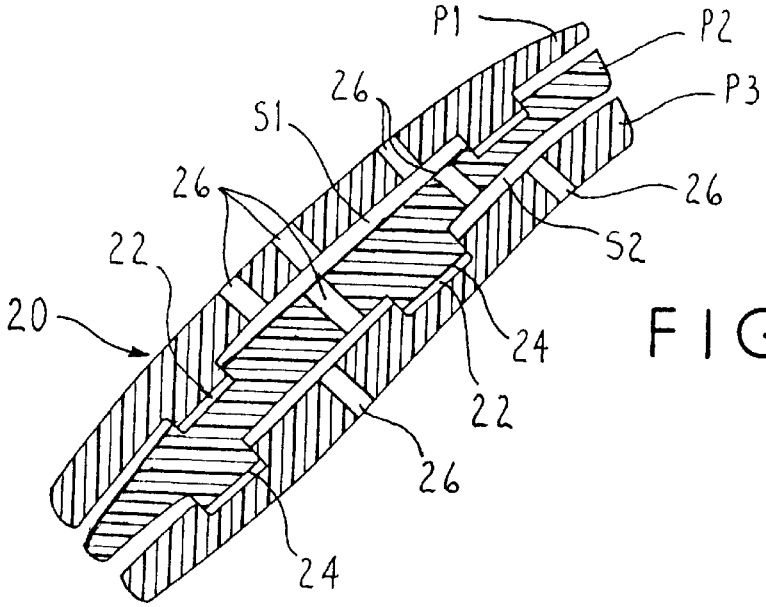
FIG. 1 is a schematic sectional view of a fugitive core-forming pattern used to make a multi-wall ceramic core pursuant to an illustrative embodiment of the invention.
Figure 2:
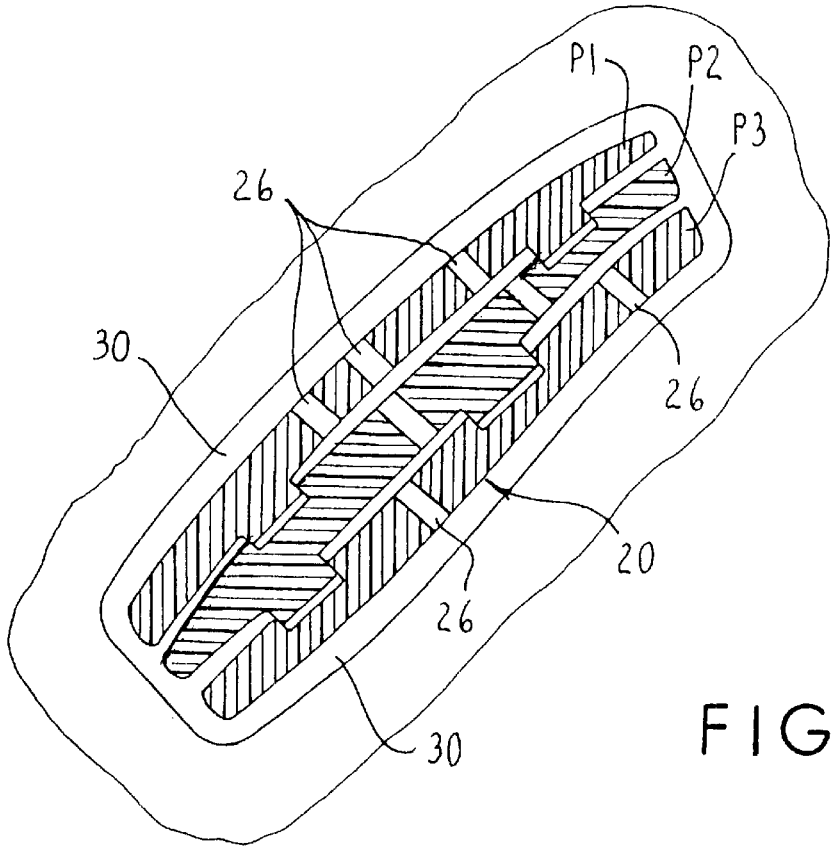
FIG. 2 is a schematic sectional view showing the pattern in a core molding die cavity.
Figure 3:
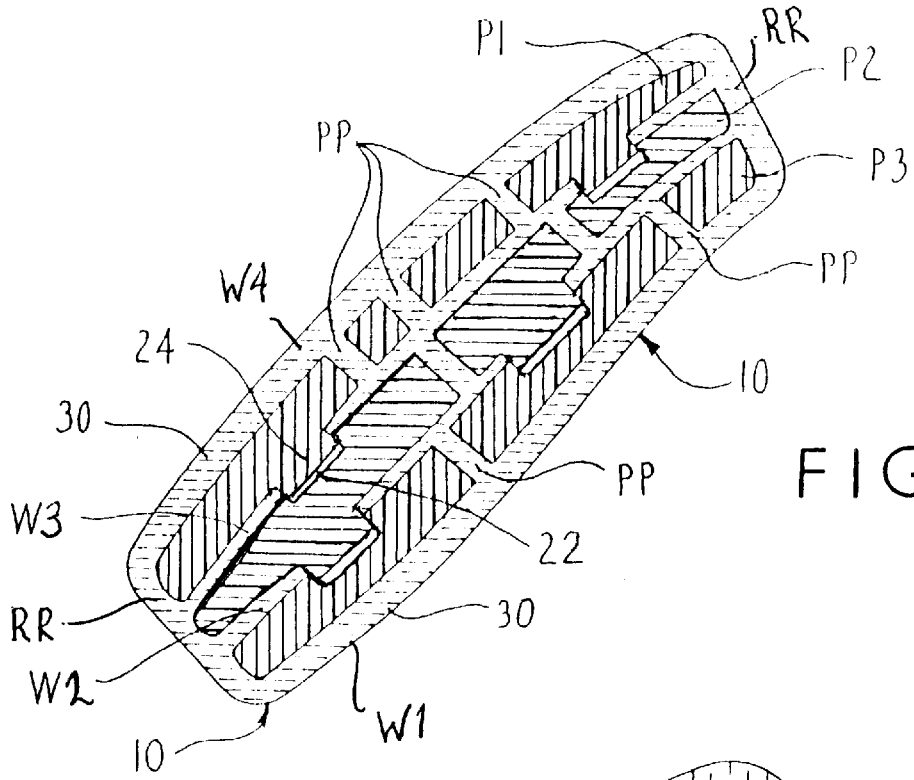
FIG. 3 is a schematic sectional view showing the multi-wall core formed about the fugitive pattern in the core die cavity.
Figure 4:
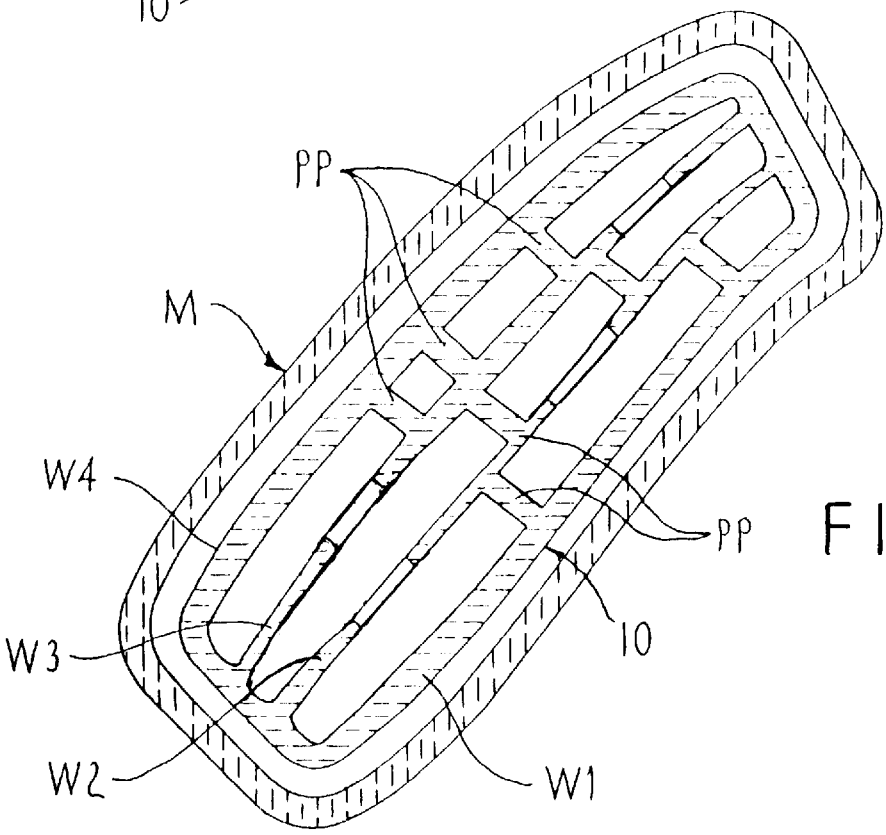
FIG. 4 is a schematic sectional view showing the multi-wall core invested in a ceramic investment casting shell mold with wax pattern removed.

Referring to FIGS. 1–3, the present invention provides in the illustrative embodiment shown a method of making a multi-wall ceramic core 10 for use in casting a multi-thin-walled airfoil (not shown) which includes a gas turbine engine turbine blade and vane. The turbine blade or vane can be formed by casting molten metallic material, such as a known nickel or cobalt base superalloy, into ceramic investment shell mold M in which the core 10 is positioned as shown in FIG. 4. The molten superalloy can be directionally solidified as is well known in the mold M about the core 10 to produce a columnar grain or single crystal casting with the ceramic core 10 therein. Alternately, the molten superalloy can be solidified in the mold M to produce an equiaxed grain casting as is well known. The core 10 is removed by chemical leaching or other suitable techniques to leave a multi-wall cast airfoil with internal passages between the walls at regions formerly occupied by the core walls W1, W2, W3, W4 as explained below.

Referring to FIG. 1, an exemplary fugitive core pattern 20 comprises a plurality (3 shown) of individual thin wall fugitive pattern elements P1, P2, P3 that are assembled or molded integrally together to form the multi-wall pattern 20. The pattern elements typically will have a general airfoil cross-sectional profile with concave and convex sides and leading and trailing edges as those skilled in the art will appreciate. The pattern elements P1, P2, P3 are formed of plastic, wax, or other fugitive material and to desired three dimensional airfoil shape by injection molding, sterolithographic, and other techniques. For purposes of illustration only, plastic or wax pattern elements P1, P2, P3 can be made with the desired configuration using conventional injection molding procedures or, alternately, using a commercially available sterolithographic machine (e.g. model SLA500 sterolithographic machine made by 3D Systems) that deposits plastic material, such as epoxy resin, in successive layers to buildup the pattern. Individual pattern elements P1, P2, P3 can be made and joined together by suitable adhesive to form pattern assembly 20. Alternately, the pattern 20 can be formed as one-piece by injection molding of wax or other suitable pattern material in a pattern die cavity with the pattern elements P1, P2, P3 integrally interconnected at molded pattern regions.

The pattern elements P1, P2, P3 can be formed with locating features, such as recesses 22 and posts 24, that mate with one another, by which the patterns can be positioned relative to one another with three dimensional accuracy. The pattern elements also can be formed with holes or other apertures 26 that will be filled with ceramic material when the core is formed. Other features which can be formed on the pattern elements include, but are not limited to, pedestals, turbulators, turning vanes and similar features used on turbine blades and vanes. The spaces S1, S2 formed between pattern elements P1, P2, P3 and the apertures 26 ultimately will be filled with ceramic core material to form the core walls when the core is formed about the pattern 20 in a core die cavity.

In production of a core 10 for casting a superalloy airfoil, such as a gas turbine engine blade or vane, the pattern elements P1, P2, P3 will have a general airfoil cross-sectional profile with concave and convex sides and leading and trailing edges as mentioned hereabove.

Pattern 20 is placed in core molding die cavity 30 having a desired core configuration and fluid ceramic material, such as a conventional fluid ceramic core compound, is introduced into the die cavity about the pattern 20 and between the pattern elements P1, P2, P3. The invention is not limited to this core forming technique and can be practiced as well using poured core molding, slip-cast molding, transfer molding or other core forming techniques. U.S. Pat. No. 5,296,308 describes injection molding of ceramic cores and is incorporated herein by reference.

The ceramic core can comprise silica based, alumina based, zircon based, zirconia based, or other suitable core ceramic materials and mixtures thereof known to those skilled in the art. The particular ceramic core material forms no part of the invention, suitable ceramic core materials being described in U.S. Pat. No. 5,394,932. The core material is chosen to be chemical leachable, or otherwise selectively removable, from the metallic airfoil casting formed thereabout as described below.

Ceramic core compounds suitable for injection into the core die cavity include a liquid vehicle and/or binder, such as wax or silicone resin, to render the slurry flowable enough to fill about and between the patterns P1, P2, P3 in the core die cavity 30. Ceramic powders are mixed with the liquid vehicle, binder, and a catalyst to form the compound or slurry.

The fluid ceramic compound can be injected or poured under pressure into the core die cavity 30 and allowed to cure or harden therein to form a green core body. The ceramic compound also can simply be gravity poured into the core die cavity. Then, the green (unfired) core 10 is removed from the die cavity 30 and visually inspected prior to further processing in order that any defective cores can be discarded.

Following removal from the respective core die cavity 30, the pattern 20 is selectively removed from the green core by thermal, chemical dissolution or other pattern removal treatment, leaving a multi-wall core. The thermal treatment involves heating the green core with the pattern thereon in a furnace to an elevated temperature to melt, vaporize or burn off the pattern material.

Then, the green core 10 is fired at elevated temperature on a ceramic setter support, or sagger comprising a bed of ceramic powder, such as alumina, (not shown). The ceramic setter support includes an upper support surface configured to support the adjacent surface of the core resting thereon during firing. The bottom surface of the ceramic setter support is placed on conventional support furniture so that multiple core elements can be loaded into a conventional core firing furnace for firing using conventional core firing parameters dependent upon the particular ceramic material of the core element.

The fired multi-wall ceramic core 10 so produced comprises a plurality of spaced apart thin wall, airfoil shaped core walls W1, W2, W3, W4 integrally joined by molded core regions RR and posts PP where ceramic material fills apertures 26.

The multi-wall ceramic core 10 then is used in further processing to form an investment shell mold thereabout for use in casting superalloy airfoils. In particular, expendable pattern wax, plastic or other material is introduced about the core 10 and in the spaces between the core walls W1, W2, W3, W4 in a pattern injection die cavity (not shown) to form a core/pattern assembly. Typically, the core 10 is placed in a pattern die cavity to this end and molten wax is injected about the core 10 and into spaces between the core walls. The core/pattern assembly then is invested in ceramic mold material pursuant to the well known "lost wax" process by repeated dipping in ceramic slurry, draining excess slurry, and stuccoing with coarse grain ceramic stucco until a shell mold is built-up on the core/pattern assembly to a desired thickness. The pattern is selectively removed from the shell mold M by thermal or chemical dissolution techniques, leaving the shell mold M having the core assembly 10 therein, FIG. 4. The shell mold then is fired at elevated temperature to develop mold strength for casting. Molten superalloy or other molten metallic material is introduced into the fired mold M with the core 10 therein using conventional casting techniques. The molten superalloy is present in the shell mold about the core 10 and in the spaces between the core walls and can be directionally solidified in the mold M about the core 10 to form a columnar grain or single crystal airfoil casting. Alternately, the molten superalloy can be solidified to produce an equiaxed grain airfoil casting. The mold M is removed from the solidified casting using a mechanical knock-out operation followed by one or more known chemical leaching or mechanical grit blasting techniques. The core 10 is selectively removed from the solidified airfoil casting by chemical leaching or other conventional core removal techniques. The spaces previously occupied by the core walls W1, W2, W3, W4 comprise internal cooling air passages in the airfoil casting, while the superalloy in the spaces between the core walls forms internal walls of the airfoil separating the cooling air passages.

The following example is offered to illustrate an embodiment of the invention to make a multi-wall core for use in casting a multi-wall airfoil casting and not to limit the scope of the invention.

Figure 5:
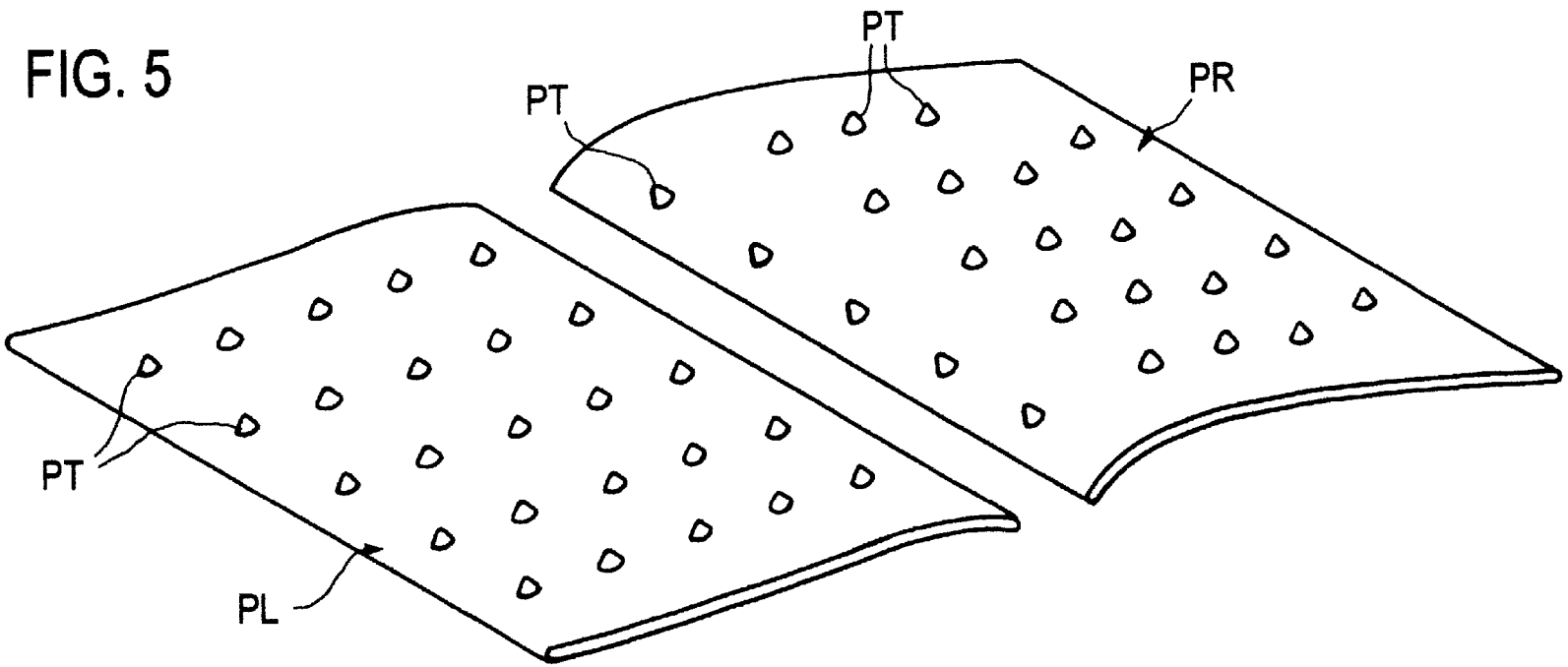
FIG. 5 is a perspective view of concave and convex airfoil halves before assembly.

Referring to FIG. 5, thin pattern elements were injection molded using a conventional paraffin-base, filled wax using conventional wax injection equipment. The pattern elements were injected to have an airfoil shape, with the left hand pattern element PL in FIG. 5 being a concave airfoil half and the right hand pattern element PR being a convex airfoil half. The airfoil halves each measured approximately 2.6 inches in length by 1.6 inches in width by 0.035 inch in thickness. The pattern wax included filler particles described in U.S. Pat. No. 5,983,982. The pattern elements are not limited to any particular size and can be made in various sizes to suit a particular ceramic core to be made for a particular casting to be made. Ceramic cores pursuant to the invention can be sized for use to make large industrial gas turbine engine (IGT) airfoil castings as well as aeorspace airfoil castings.

The pattern elements (airfoil halves) included a pattern of surface bumps or protrusions PT that were already present on the injection molding die surfaces. Other surface features can be provided on the pattern elements as desired for a particular airfoil casting to be made. Elongated ribs RB1 were hand wax welded to the exterior surfaces of the pattern elements to serve as locators or bumpers to position the pattern in the core molding die cavity to be described. Other die cavity locator features could be provided on the pattern elements PL and PR in practice of the invention in lieu of the ribs RB1, which were used merely for convenience. The ribs RB1 extended generally radially from the exterior surface of the pattern elements. Elongated ribs RB2 shown in dashed lines also may be hand wax welded on interior surfaces of the pattern elements PL, PR and adapted to be mated and joined together. The interior ribs RB2 are optional and can be omitted. The pattern elements PL, PR then were bonded together to form a core-forming pattern CP, FIG. 6. In particular, the pattern elements PL, PR were wax welded along their mating leading and trailing edges by manually-made wax welds WD. The ribs RB2 also were wax welded together along their lengths at weld WD.

Figure 6:
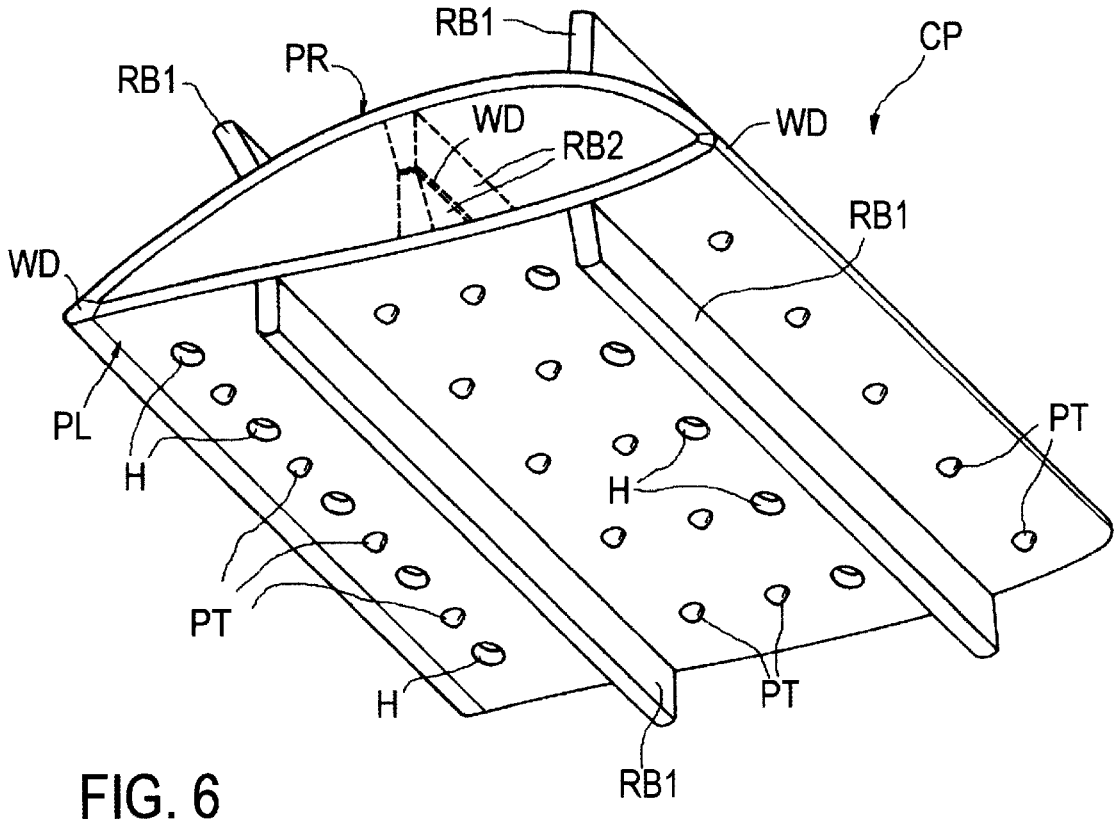
FIG. 6 is a perspective view of the assembled wax airfoil core-forming pattern after spacer ribs are attached.

Holes or openings H then were drilled through the wax welded pattern elements PL, PR using a carbide end mill to provide paths for flow of fluid ceramic slurry into the space between the pattern elements, FIG. 6, such that the inner core region CI and the outer core skins or walls CW will be integrally interconnected.

Figure 9:
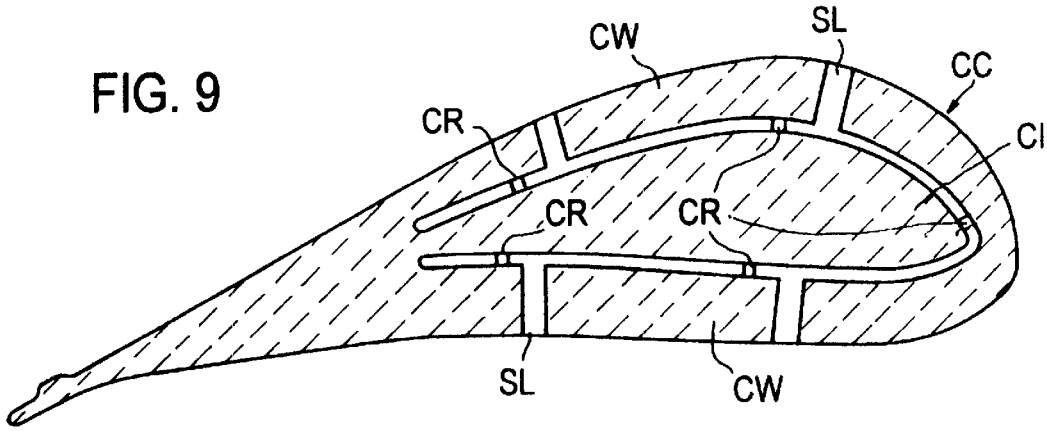
FIG. 9 is a sectional view through the airfoil region of a multi-wall ceramic core produced by another example of the invention.

Some of the pattern elements PL, PR were assembled as described above with a plurality of preformed ceramic connector rods inserted through the wall thickness of the pattern elements PL, PR, to provide ceramic connector rods CR in the final core CC, FIG. 9, such that the rods will interconnect the inner core region CI and outer core skins or walls CW.

Figure 7:
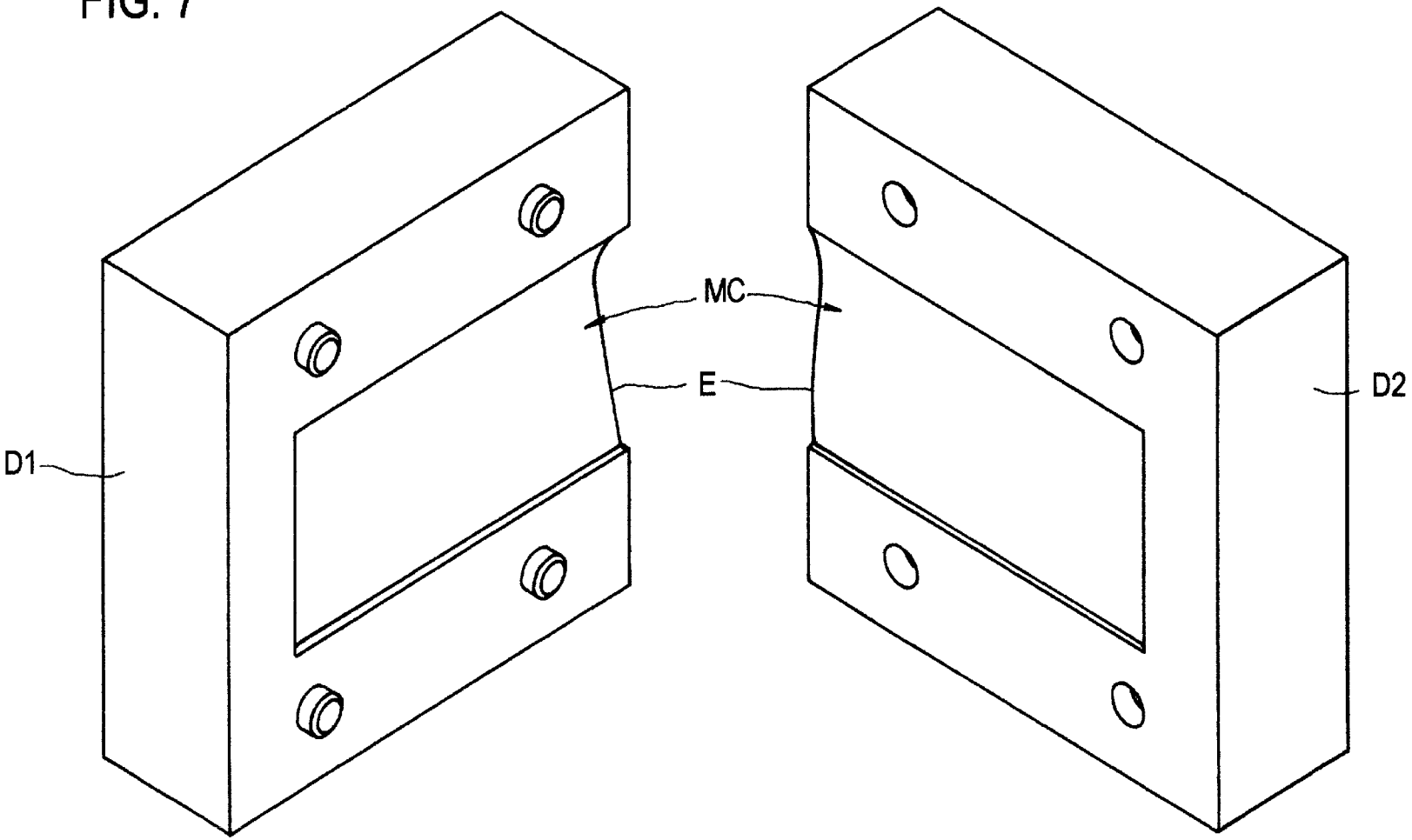
FIG. 7 is an exploded perspective view of steel core-forming mold.
Figure 8:
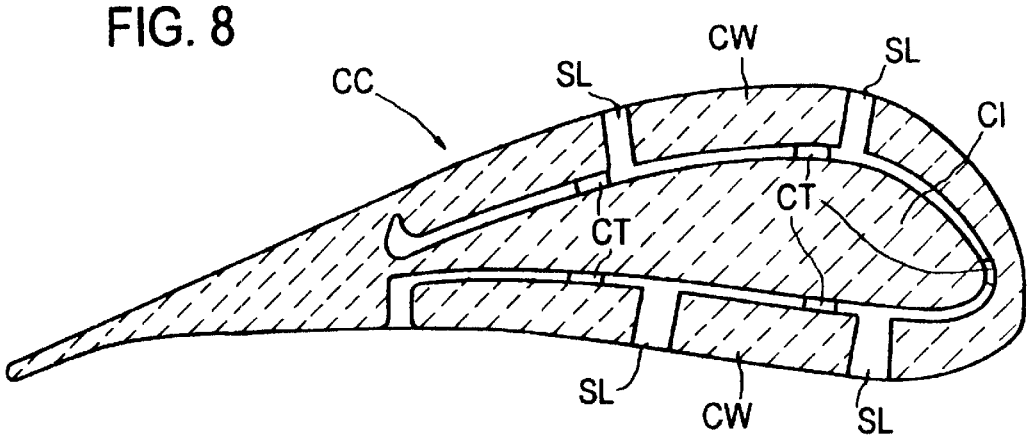
FIG. 8 is a sectional view through the airfoil region of a multi-wall ceramic core produced by an example of the invention.

The assembled wax pattern elements PL, PR were positioned in a steel core molding cavity, FIG. 7, having a molding cavity MC with the desired shape of the core to be made. The molding cavity MC is formed by two mating mold die halves D1, D2 when they are mated together. For example, the core molding cavity was 4 inches in length and 2.4 inches in chord width with a pitch of 0.65 inch. A fluid ceramic core compound comprising a conventional catalytic reaction silica based poured core material (morpholine catalyzed ethyl silicate) was gravity poured (no pressure applied) into the molding cavity MC via the open end E of the cavity. In practicing the invention, the core compound can be introduced into the core molding cavity under pressure, typically in the range of 100 to 200 psi, such as is practiced using a conventional poured core press. After setting of the core compound, the green multi-wall ceramic core was removed from the molding cavity MC. Each core then was processed in conventional manner by open flame treatment where the core is exposed to an open flame of a propane torch, then a kiln firing (1730 degrees F for a total of 18 hours) and then dipping in colloidal silica to seal the exposed exterior surfaces of the core. The wax pattern was selectively removed from each green core by the open flame treatment, which heats and melts the wax pattern out of the green ceramic core. Transverse cross-sections through the multi-wall airfoil region of a representative ceramic core CC pursuant to the invention made without the above ceramic rods is shown in FIG. 8 and a representative ceramic core pursuant to the invention made with the ceramic rods is shown in FIG. 9. The cores CC include slots SL where the ribs RB1 were present. The inner core region CI is connected by integrally formed connector regions CT to the outer skin or wall of the core. The connector regions CT are formed by ceramic core compound flowing through and residing in holes H shown in FIG. 6.

The ceramic cores made pursuant to the invention were inspected and found acceptable for casting.

Figure 10:
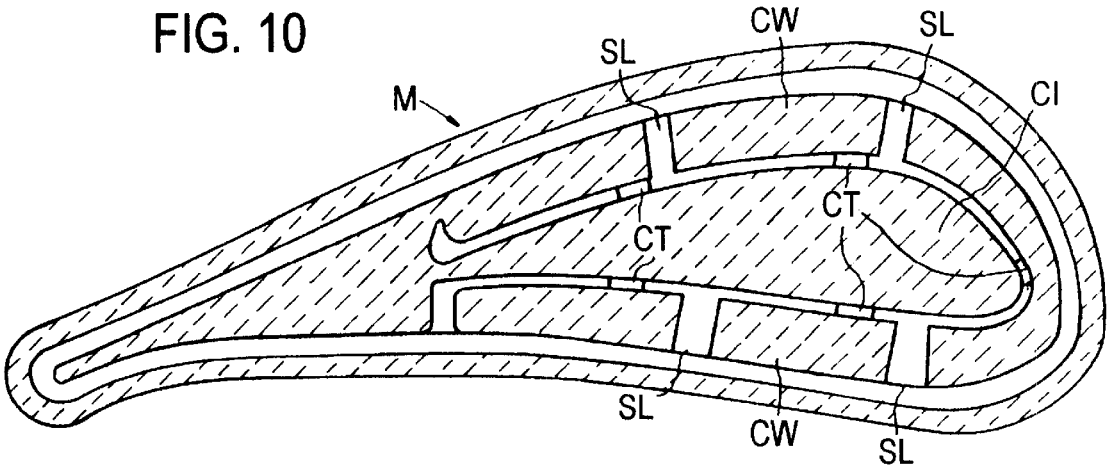
FIG. 10 is a sectional view through a ceramic shell mold and the airfoil region of a multi-wall ceramic core produced by an example of the invention.
Figure 11:
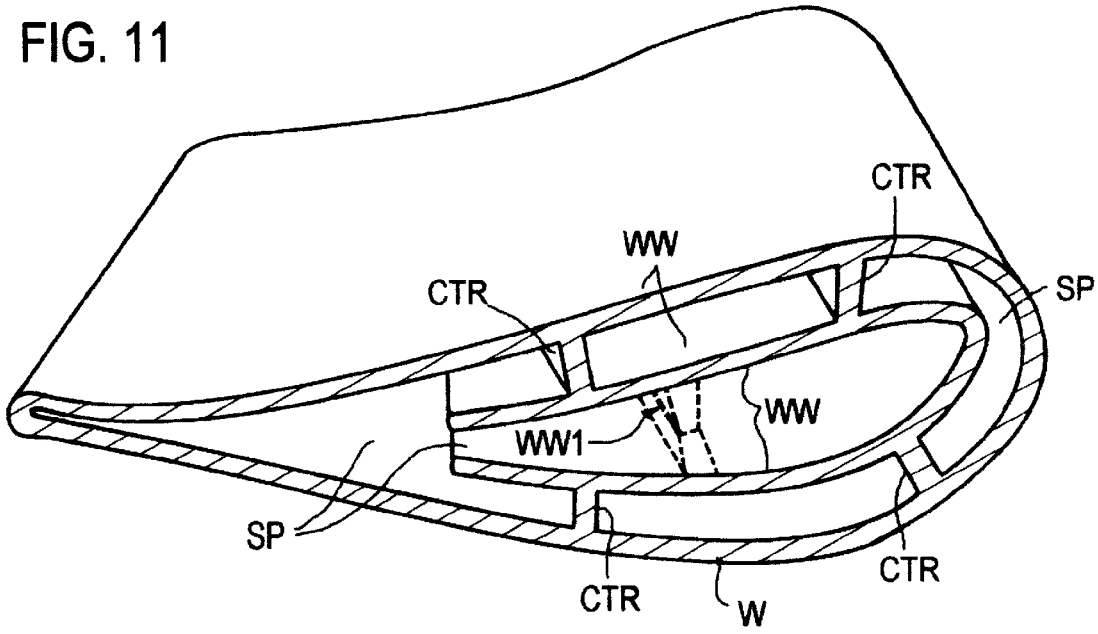
FIG. 11 is a sectional view of the airfoil region of a multi-wall nickel base superalloy casting produced using a ceramic core of the invention.

For purposes of casting tests, the above described ceramic cores were hand mocked by wrapping wax sheets about the cores to simulate a gas turbine engine airfoil pattern. The wrapped cores were invested in a ceramic investment shell mold M, FIG. 10, using the conventional lost wax process to form a shell mold about the wrapped cores. The shell molds had a silica facecoat for contacting with the melted superalloy described below. The simulated pattern then was removed from each green shell mold by thermal treatment, leaving the shell mold with the core therein. The shell mold SM then was fired at elevated temperature to provide mold strength for casting. A nickel base superalloy sold under the name CMSX-4 by Cannon Muskegon Corporation, Muskegon, Mich., was melted and cast into the shell molds having the cores therein followed by single crystal solidification of the melted superalloy to produce a single crystal casting in each mold. FIG. 11 illustrates a representative one-piece airfoil single crystal casting of the type produced by the invention having integrally cast multiple walls WW after conventional removal of the shell mold and ceramic core made pursuant to the invention from the casting by a knock-out operation and chemical leaching. The casting of FIG. 11 was produced using a core having an overall configuration similar to that of FIG. 9. The inner wall WWI shown in dashed lines could be formed in the casting if the inner rib RB2, FIG. 6, were present on the core pattern. In FIG. 11, the walls WW of the casting are connected by integrally cast connector regions CTR formed where slots, such as slots SL, were present in the core. Internal cooling passages or spaces SP are formed in the casting at regions previously occupied by the ceramic core.

It will be apparent to those skilled in the art that various modifications and variations can be made in the embodiments of the present invention described above without departing from the spirit and scope of the invention as set forth in the appended claims.

We claim:

1. A method of making a multi-wall ceramic core for casting an airfoil, comprising forming a fugitive pattern having multiple thin wall pattern elements, placing the pattern in a core molding die cavity having a core configuration with said pattern elements providing core wall-forming spaces in said die cavity including an outer space between the pattern and a wall of the die cavity and an inner space within the pattern, introducing a fluid ceramic material into the die cavity in said outer space and in said inner space to form an outer core wall interconnected to an inner core region of said ceramic core, removing said ceramic core from the die cavity, and selectively removing the pattern from said ceramic core.

2. The method of claim 1 wherein at least one of said pattern elements includes a plurality of openings extending through the thickness thereof between said core wall-forming spaces such that said spaces and said openings are filled with ceramic material in said die cavity.

3. The method of claim 1 wherein the fugitive pattern comprises multiple pattern elements assembled together.

4. The method of claim 1 wherein the fugitive pattern comprises pattern elements molded integrally together.

5. The method of claim 1 wherein the pattern comprises a material selected form the group consisting of wax and a plastic material.

6. The method of claim 5 wherein the plastic material comprises epoxy resin.

7. The method of claim 1 wherein the pattern elements are formed by sterolithographic deposition.

8. The method of claim 1 including heating said ceramic core to superambient temperature to develop core strength for casting.

9. A method of casting an airfoil wherein the core of claim 8 is positioned in an investment mold and molten metallic material is cast in the mold about the core.

10. A method of making a multi-wall ceramic core for casting an airfoil, comprising forming a fugitive pattern having multiple thin wall pattern elements, at least one of said pattern elements having one or more openings through its thickness, placing the pattern in a core molding die cavity having a desired core configuration with said pattern elements providing core wall-forming spaces in said die cavity, introducing a fluid ceramic material into the die cavity about the pattern and in said spaces and said one or more openings to form said ceramic core having outer walls integrally connected to an inner core region by ceramic material in said one or more openings, removing said ceramic core from the die cavity, and selectively removing the pattern from said ceramic core to provide a multi-wall core.

11. The method of claim 10 wherein each of said pattern elements has multiple openings through its respective thickness.

12. The method of claim 10 including disposing one or more ceramic rods in said at least one of said pattern elements through its thickness.

13. Combination of a multi-wall ceramic core and pattern including multiple thin wall pattern elements having a space therebetween, at least one of said pattern elements having one or more openings through its respective thickness, said core being disposed about said pattern to provide outer core walls and disposed in said space to provide an inner core region, said outer core walls and said inner core region being integrally connected by ceramic material in said one or more openings.

14. The combination of claim 13 wherein each of said pattern elements has multiple openings through its respective thickness.

15. The combination of claim 13 including one or more ceramic rods in said at least one of said pattern elements through its thickness.

16. Combination of a multi-wall ceramic core and a pattern including multiple thin wall pattern elements having a space therebetween, said core being disposed about said pattern to provide outer core walls and in said space to provide an inner core region interconnected to said outer core walls.

17. The combination of claim 16 wherein the pattern comprises wax or plastic material.

18. The combination of claim 16 wherein the outer core walls and the inner core region are interconnected by a ceramic rod in the pattern through its thickness.

19. The combination of claim 16 wherein the outer core walls and the inner core region are interconnected by ceramic material residing in a hole in one or more of the pattern elements.

* * * * *